US008651036B2

(12) United States Patent
Yamanashi et al.

(10) Patent No.: US 8,651,036 B2
(45) Date of Patent: Feb. 18, 2014

(54) SEWING MACHINE OPERATING DEVICE AND SEWING MACHINE PROVIDED THEREWITH

(75) Inventors: Yoko Yamanashi, Konan (JP); Hiroyuki Suzuki, Gamagori (JP); Kazuki Kojima, Gamagori (JP); Kei Kawase, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 259 days.

(21) Appl. No.: 13/217,969

(22) Filed: Aug. 25, 2011

(65) Prior Publication Data

US 2012/0060734 A1 Mar. 15, 2012

(30) Foreign Application Priority Data

Sep. 14, 2010 (JP) ..... 2010-205551

(51) Int. Cl.
*D05B 69/18* (2006.01)

(52) U.S. Cl.
USPC ..... 112/277

(58) Field of Classification Search
USPC ..... 112/271, 277, 275, 274
See application file for complete search history.

(56) References Cited

U.S. PATENT DOCUMENTS

| | | | | |
|---|---|---|---|---|
| 3,253,562 | A | | 5/1966 | Kristen |
| 3,400,677 | A | | 9/1968 | Bowers et al. |
| 4,100,868 | A | | 7/1978 | Reinecke et al. |
| 4,299,182 | A | | 11/1981 | Tanaka |
| 4,426,947 | A | | 1/1984 | Marshall |
| D332,103 | S | * | 12/1992 | Off et al. ..... D15/72 |
| 8,286,569 | B2 | * | 10/2012 | Nishiyama et al. ..... 112/470.01 |
| 2010/0313805 | A1 | | 12/2010 | Kishi |

FOREIGN PATENT DOCUMENTS

| | | |
|---|---|---|
| JP | U-64-011182 | 1/1989 |
| JP | A-10-118380 | 5/1998 |
| JP | A-2012-61043 | 3/2012 |

OTHER PUBLICATIONS

U.S. Appl. No. 13/216,864, filed Aug. 24, 2011 in the name of Maki et al.

Jul. 19, 2012 Office Action issued in U.S. Appl. No. 13/216,864.

* cited by examiner

*Primary Examiner* — Danny Worrell
(74) *Attorney, Agent, or Firm* — Oliff PLC

(57) ABSTRACT

A sewing machine operating device includes a base, a connection unit which is connectable to a sewing machine body, an output unit which is configured to generate and deliver an operation signal according to an action of a user's foot, a placement pedestal that is configured to receive the user's foot, a support unit which supports the placement pedestal so that the placement pedestal is movable in any direction on a plane that includes an upper surface of the base, and a detection unit which is configured to detect whether the placement pedestal or user's foot is located at any one of different predetermined positions when the placement pedestal is moved with the user's foot being placed on the placement pedestal.

12 Claims, 12 Drawing Sheets

SEWING MACHINE OPERATING DEVICE AND SEWING MACHINE PROVIDED THEREWITH

CROSS-REFERENCE TO RELATED APPLICATIONS

This application is based upon and claims the benefit of priority from the prior Japanese Patent Application No. 2010-205551 filed on Sep. 14, 2010, the entire contents of which are incorporated herein by reference.

BACKGROUND

1. Technical Field

The present disclosure relates to a sewing machine operating device which is connected to a sewing machine body to work the sewing machine according to an action of user's foot and a sewing machine provided with the operating device.

2. Related Art

Conventional sewing machines include a type in which a user connects a foot pedal to a sewing machine and operates the foot pedal with his/her foot thereby to instruct an operation of the sewing machine. According to this known configuration, the user operates or presses the foot pedal to start or stop a sewing operation and to adjust a sewing speed or a rotational speed of a sewing machine motor without using his/her hands.

Recently, furthermore, an operating device provided with a switch has been proposed. The switch is operated by user's foot in order that an operation to move a presser foot upward may be instructed or a thread cutting operation may be instructed. In this case, the aforementioned switch is disposed lateral to the foot pedal and includes an operating member such as a push button or a lever. The user operates the operating member by one side of his/her foot.

In the foregoing construction, however, the user needs to rotatively move or swing his/her toe in the right-left direction while slightly floating the toe from the foot pedal. This is not necessarily an easy operation for the user.

SUMMARY

Therefore, an object of the disclosure is to provide a sewing machine operating device which operates a sewing machine according to an action of a foot and can improve the operability, and a sewing machine provided with the operating device.

The present disclosure provides a sewing machine operating device comprising a base, a connection unit which is connectable to a sewing machine body, an output unit which is configured to generate and deliver an operation signal according to an action of a user's foot, a placement pedestal that is configured to receive the user's foot, a support unit which supports the placement pedestal so that the placement pedestal is movable in any direction on a plane that includes an upper surface of the base, and a detection unit which is configured to detect whether the placement pedestal or user's foot is located at any one of different predetermined positions when the placement pedestal is moved with the user's foot being placed on the placement pedestal.

The disclosure also provides a sewing machine comprising a sewing machine body and a sewing machine operating device including a base, a connection unit which is connectable to a sewing machine body, an output unit which is configured to generate and deliver an operation signal according to an action of a user's foot, a placement pedestal that is configured to receive the user's foot, a support unit which supports the placement pedestal so that the placement pedestal is movable in any direction on a plane that includes an upper surface of the base, and a detection unit which is configured to detect whether the placement pedestal or user's foot is located at any one of different predetermined positions when the placement pedestal is moved with the user's foot being placed on the placement pedestal.

DETAILED DESCRIPTION

A first embodiment will be described with reference to FIGS. 1 to 7. The first embodiment is directed to an operating device for use with a household electronic sewing machine, for example.

Figure 1:
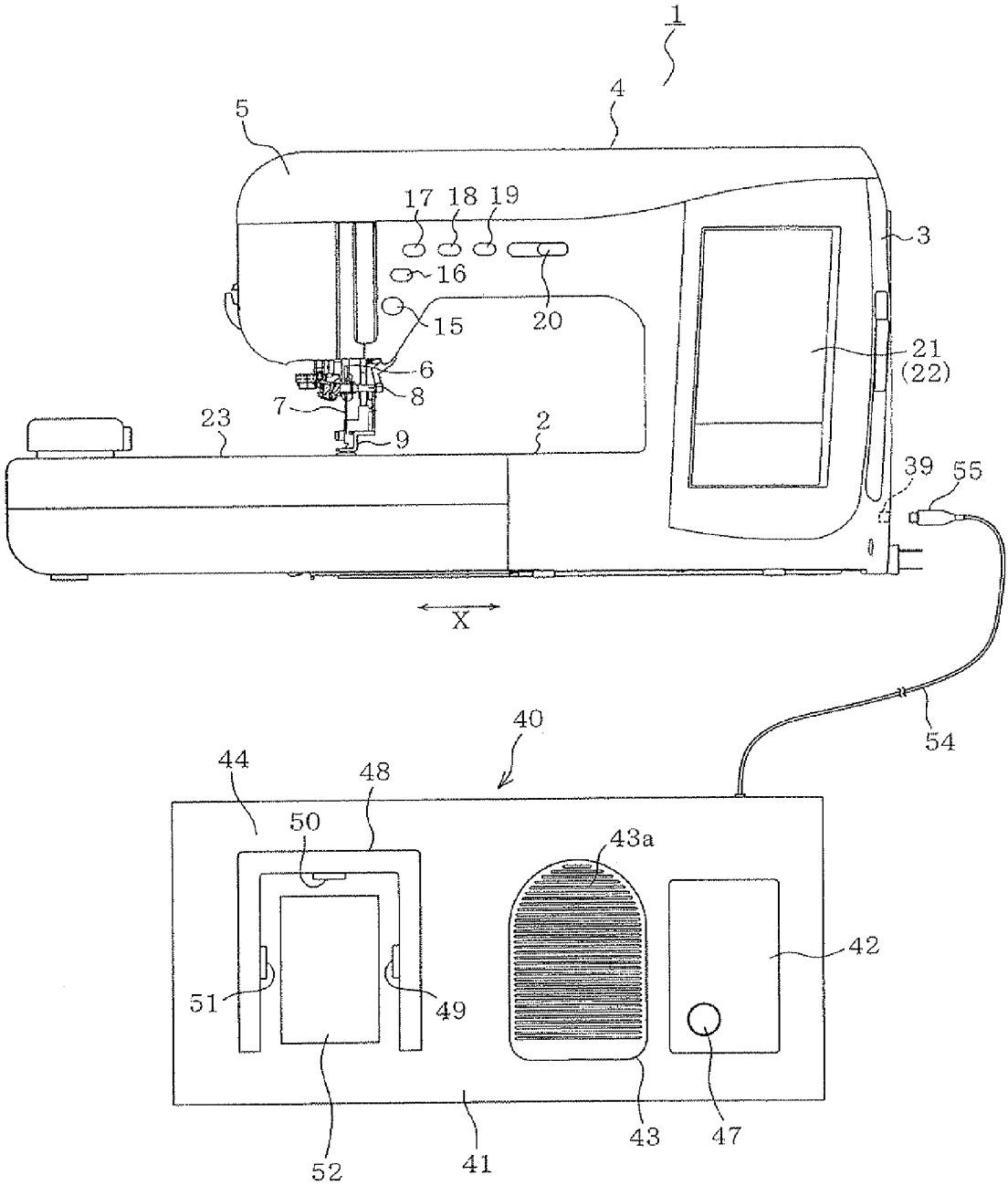
FIG. 1 shows an overall construction of a sewing machine to which a sewing machine operating device according to one embodiment is to be connected.

Referring to FIG. 1, a sewing machine body 1 of the sewing machine is shown. An overall construction of the sewing machine body 1 will now be described. The sewing machine body 1 comprises a sewing machine bed 2 extending in the X direction or a right-left direction, a pillar 3 extending upward from a right end of the sewing machine bed 2 and an arm 4 extending leftward from an upper end of the pillar 3 as viewed in FIG. 1. The bed 2, the pillar 3 and the arm 4 are formed integrally with one another. The arm 4 has a distal end serving as a head 5. A needle bar 6 is mounted on the head 5 so as to be movable upward and downward and swingable in the X direction. The needle bar 6 has a lower end to which a needle 7 is attached. A presser bar 8 is also mounted on the head 5 so as to be located behind the needle bar 6 (the needle 7). The presser bar 8 has a lower end on which a presser foot 9 is detachably or replaceably mounted. A known presser driving mechanism is provided in the head 5 to move the presser foot 9, namely, the presser bar 8 between upper and lower positions. The presser driving mechanism is driven by a presser drive motor 10 (see FIG. 2).

Figure 2:
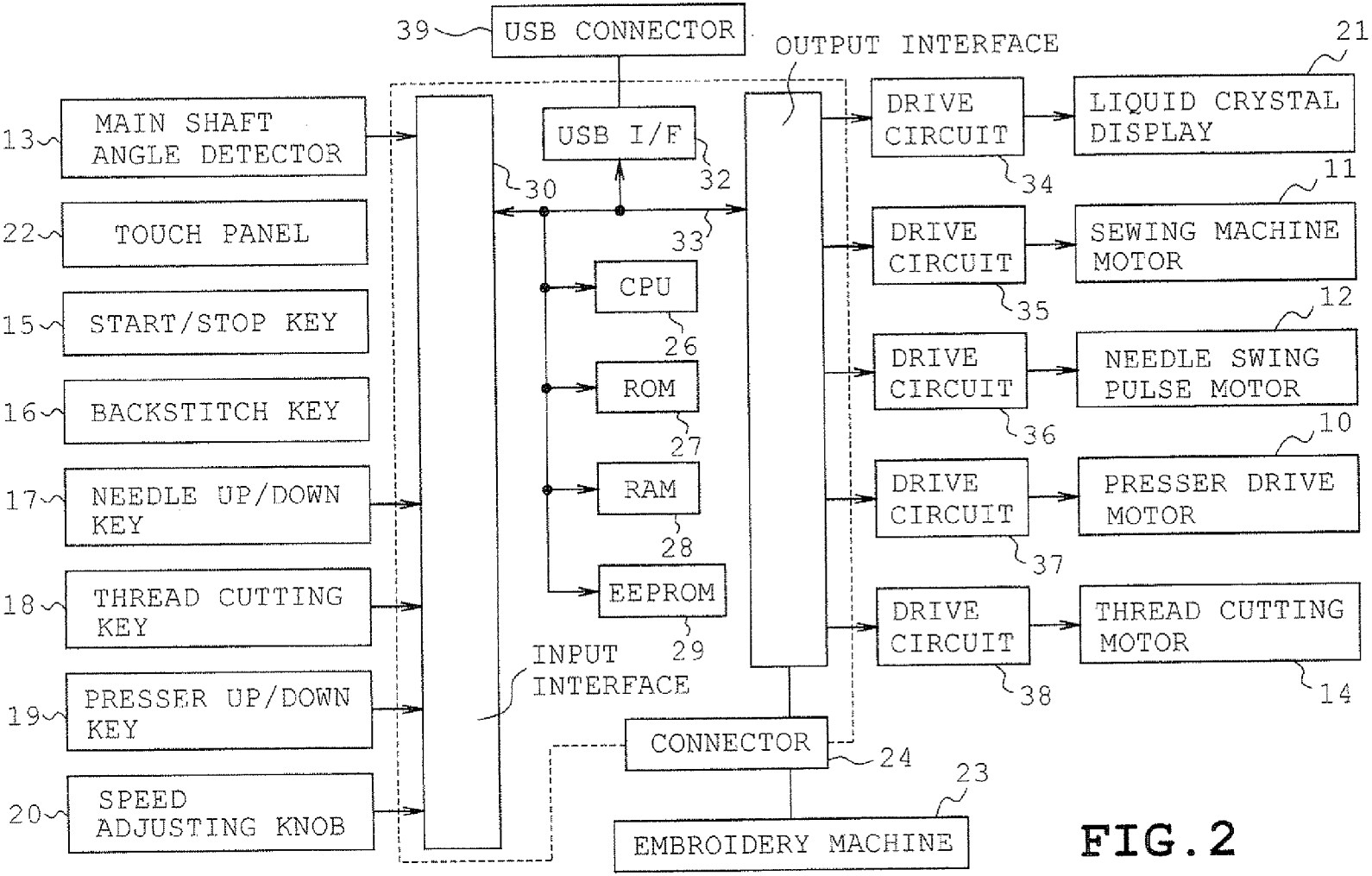
FIG. 2 is a schematic block diagram showing an electrical arrangement of the sewing machine.

In the arm 4 are provided a main shaft driven by a sewing machine motor 11 which is shown only in FIG. 2 and a main shaft angle detector 13 which detects a rotational angle of the main shaft and which is shown only in FIG. 2. In the head 5 are provided a needle bar driving mechanism which moves the needle bar 6 upward and downward and a needle thread take-up driving mechanism which moves a needle thread take-up upward and downward in synchronization with the upward and downward movement of the needle bar 6, although neither mechanism is shown. A needle bar swinging mechanism, a thread tension adjusting device and the like are further provided in the head 5. The needle bar swinging mechanism swings the needle bar 6 in the X direction perpendicular to a cloth feed direction by a needle swing pulse motor 12 (see FIG. 2) serving as a drive source. The thread tension adjusting device adjusts a tension of a needle thread. The needle bar driving mechanism and the needle thread take-up driving mechanism are driven by the main shaft. A rotational angle of the main shaft is detected by the main shaft angle detector 13, whereby a vertical position of the needle bar 6 is specified.

A needle plate (not shown) is mounted on an upper surface of the bed 2. In the bed 2 are provided a feed dog driving mechanism which drives a feed dog in synchronization with the upward and downward movement of the needle bar 6, a rotary hook which houses a bobbin and forms stitches in cooperation with the needle 7, an automatic thread cutting mechanism and the like. The automatic thread cutting mechanism includes a known mechanism which is driven by a thread cutting motor 14 serving as a drive source as shown in FIG. 2. Both bobbin and needle threads are automatically cut by the automatic thread cutting mechanism at a lower surface side of the needle plate after completion of a sewing operation.

An embroidery machine 23 is detachably attached to a left side portion of the bed 2. An embroidery frame (not shown) holding a workpiece cloth is adapted to be attached to the embroidery machine 23. The embroidery frame attached to the embroidery machine 23 is moved on the bed 2 freely in the X direction and the Y direction or a front-back direction perpendicular to the X direction. The embroidery machine 23 attached to the bed 2 is electrically connected via a connector 24 (see FIG. 2) provided in the bed 2 to a control device 25 of the sewing machine as will be described later. In the embodiment, however, a sewing machine operating device 40 is used in a normal sewing in which the embroidery machine 23 is not used, as will be described later. The sewing machine operating device will hereinafter be referred to as "operating device."

Various operation keys are provided on the front of the arm 4 as shown in FIG. 1. More specifically, the operation keys include a start/stop key 15 instructing start or stop of the sewing machine motor 11, a backstitch key 16 instructing backstitch, a needle up/down key 17 instructing switching between needle-up and needle-down with respect to a stop position of the needle bar 6, a thread cutting key 18 instructing thread cutting, a presser up/down key 19 instructing to move the presser foot 9 upward or downward and a speed adjusting knob 20 adjusting a sewing speed or a rotational speed of the sewing machine motor 9. The user manually operates the aforementioned operation keys when the operating device 40 is not connected to the sewing machine body 1.

A large-sized vertically long liquid crystal display (LCD) 21 capable of full-color display is mounted on the front of the pillar 3. The LCD 21 as a surface on which a touch panel 2 is mounted. When depressing the touch panel 22, the user can select a desired ordinary pattern or embroidery pattern or can cause the sewing machine to execute various functions.

A control device 25 controlling the whole sewing machine body 1 mainly comprises a microcomputer as shown in FIG. 2. More specifically, the control device 25 includes a CPU 26, a ROM 27, a RAM 28, an EEPROM 29, an input interface 30, an output interface 31 and a USB interface 32, all of which are connected to one another by a bus 33. The ROM 27 stores a control program for controlling a sewing operation and various data inclusive of stitch data necessary for the sewing operation.

To the input interface 30 are connected the main shaft angle detector 13, the touch panel 22, the start/stop key 15, the backstitch key 16, the needle up/down key 17, the thread cutting key 18, the presser up/down key 19 and the speed adjusting knob 20. When operated, these detector, panel, knob and keys generate respective operation signals, which are supplied to the control device 25. The LCD 21 is connected via a drive circuit 34 to the output interface 31. The sewing machine motor 11, the needle swing pulse motor 12, the presser drive motor 10 and the thread cutting motor 14 are connected via respective drive circuits 35, 36, 37 and 38 to the output interface 31. The control device 25 then controls these motors to execute the sewing operation. A connector 24 is also connected to the output interface 31.

The control device 25 and that is, the CPU 26 each have a USB host function and are provided with a USB connector (or port) 39 connected to the USB interface 32. The USB connector 39 is provided in a right side wall of the pillar 3 of the sewing machine body 1 as shown in FIG. 1. The operating device 40 is detachably connected to the USB connector 39. The operating device 40 generates an operation signal according to an action of user's foot, as will be described later.

The control device 25 reads the operation signals generated by the operating device 40 to execute processing according to the operation signals while the operating device 40 is connected to the sewing machine body 1. More specifically, the control device 25 executes control for start or stop of a sewing operation of the sewing machine motor 11, a sewing speed or adjustment of a rotational speed of the sewing machine motor 11, an operation for switching the stop position of the needle bar 6 between the needle-up and the needle-down, the backstitch operation, a thread cutting operation by the automatic thread cutting mechanism and a raising or lowering operation of the presser foot 9 by the presser drive mechanism.

Figure 3C:
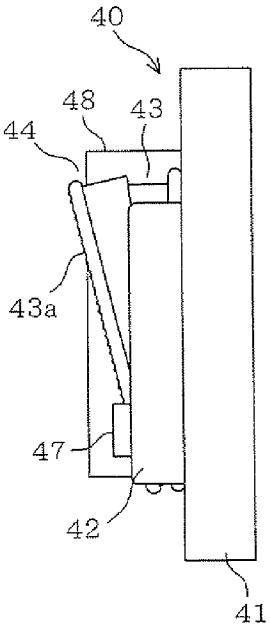
FIGS. 3A, 3B and 3C are plan, front and right side views of the sewing machine operating device respectively.
Figure 3A:
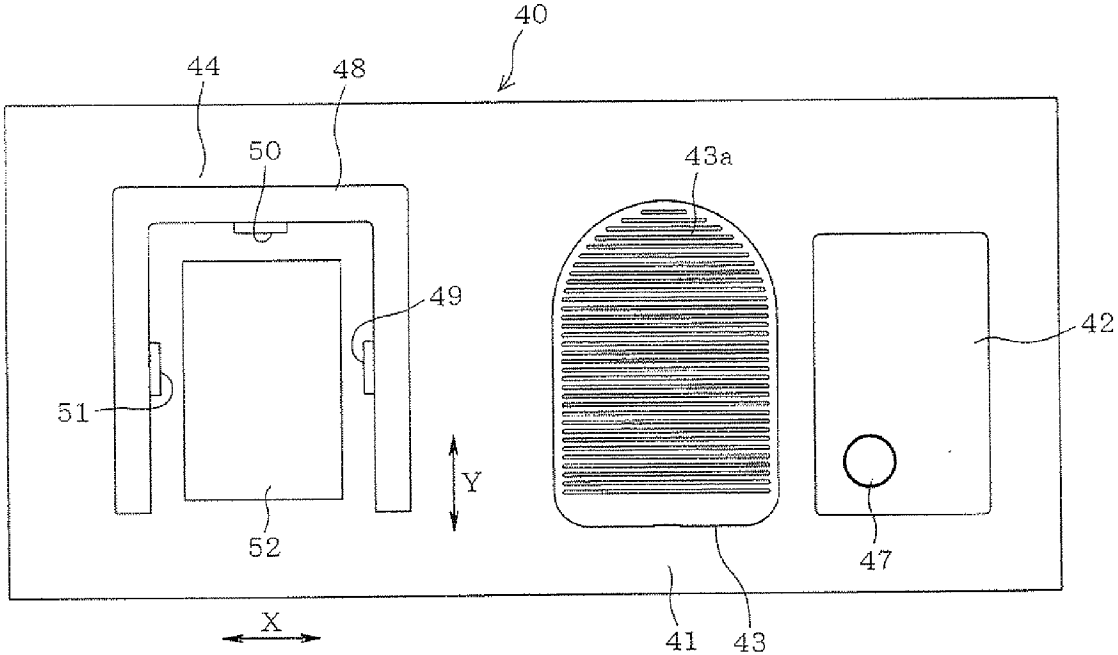
Figure 3B:
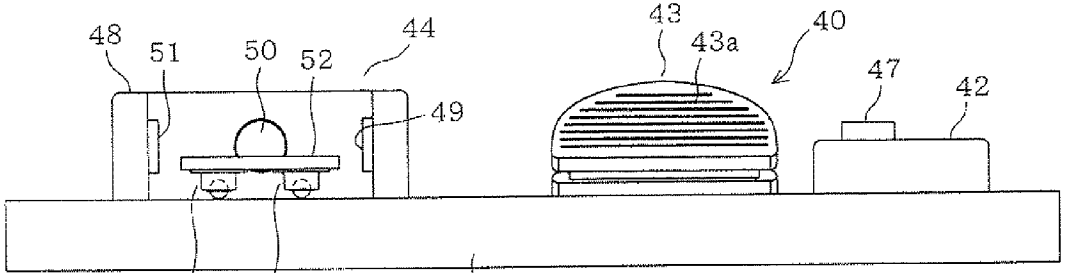

The operating device 40 will now be described in detail with further reference to FIGS. 3A to 5 as well as with FIGS. 1 and 2. The operating device 40 includes a base 41, a control box 42, a pedal device 43 and a switch operation portion 44 as shown in FIGS. 3A to 3C. The base 41 is formed into an oblong rectangular flat shape and has an upper surface on which the control box 42, the pedal device 43 and the switch operation portion 44 are provided sequentially from the right. The sewing machine body 1 is placed on a working table or a working desk, and the operating device 40 is placed on the floor, namely, under foot of the user although the arrangement is not shown. The user sits on a chair (not shown) to operate the operating device 40 by his/her foot.

Figure 6:
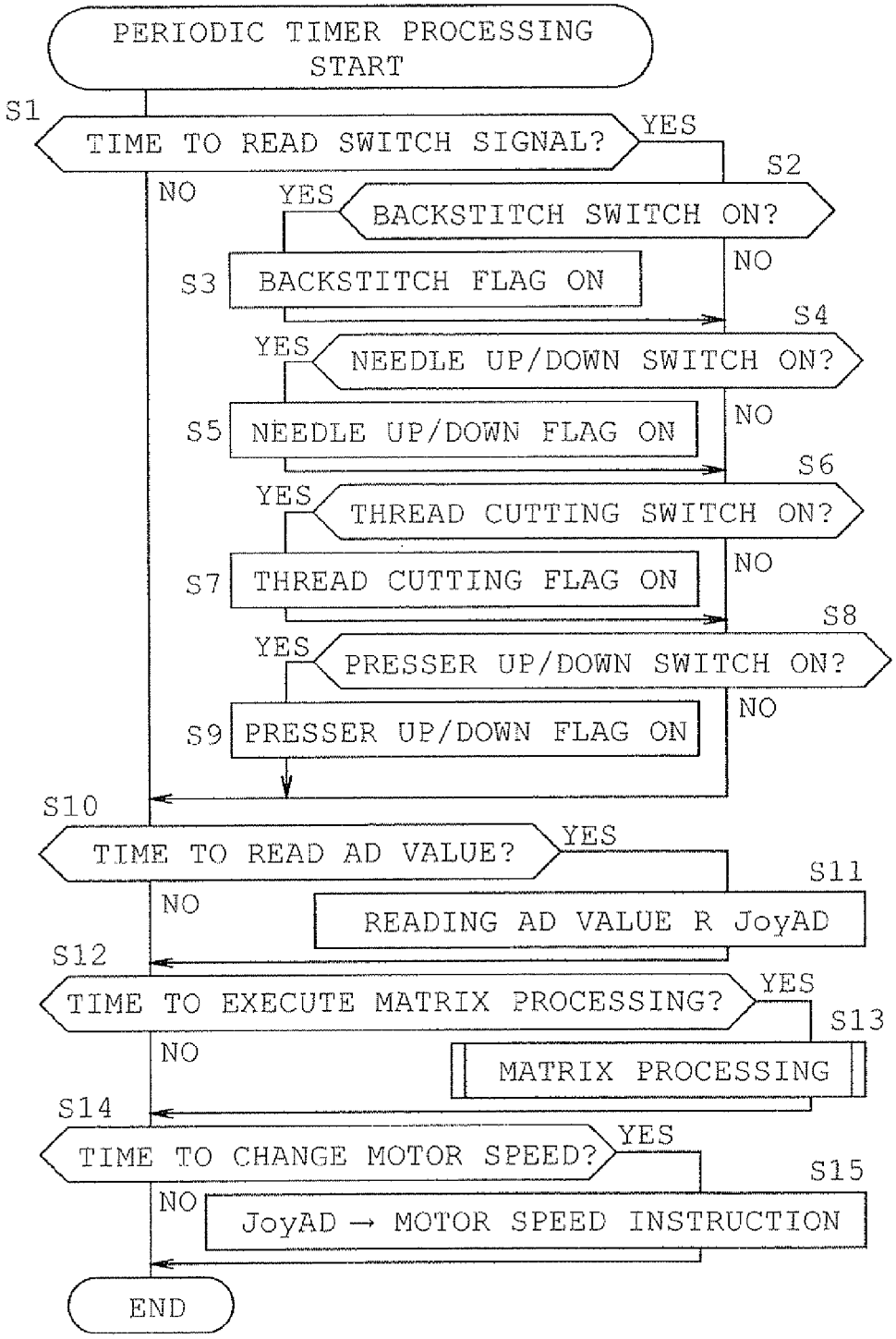
FIG. 6 is a flowchart showing a processing procedure of operation of the sewing machine operating device executed by a control device provided in a sewing machine body.

The pedal device 43 includes an actuating portion **43*a* which is pressed by user's foot (a right foot, in this case) and a variable resistor (not shown) which varies a resistance value thereof according to an amount of press applied to the actuating portion 43*a*. The pedal device 43 generates and delivers a voltage signal presenting an administrative distance (AD) value according to the press amount of the actuating portion 43*a*. The control box 42 is formed into the shape of a thin rectangular box and houses a circuit board provided with a communication microcomputer 45, a USB interface 46 and the like as shown in FIG. 6. A needle up/down switch 47 serving as an operating member is mounted on an upper surface of the control box 42 and comprises a push-button switch. The needle up/down switch 47 instructs to switch a stop position of the needle bar 6 between needle-up and needle-down. The needle up/down switch 47** is pressed downward by a sole of the user's right foot.

The switch operation portion 44 is operated by the user's left foot and configured as follows. The switch operation portion 44 includes a rising wall 48, a backstitch switch 49, a presser up/down switch 50 and a thread cutting switch 51. The rising wall 48 is formed on the base and includes a right wall, a rear wall and a left wall and an open front, as shown in FIGS. 1, 3A, etc. A space defined inside the rising wall 48 is large enough to accommodate the user's left foot. The backstitch switch 49 instructs a backstitching operation. The presser up/down switch 50 instructs an operation of moving the presser foot 9 upward or downward. The switches 49, 50 and 51 are mounted on inner wall surfaces of the right, rear and left walls of the rising wall 48, respectively. The switches 49 to 51 comprise pushbutton switches depressed by the user or the like with his/her toe, a left side surface of his/her foot and a right side surface of his/her foot and serve as detection units which will be described later, respectively.

Figure 4A:
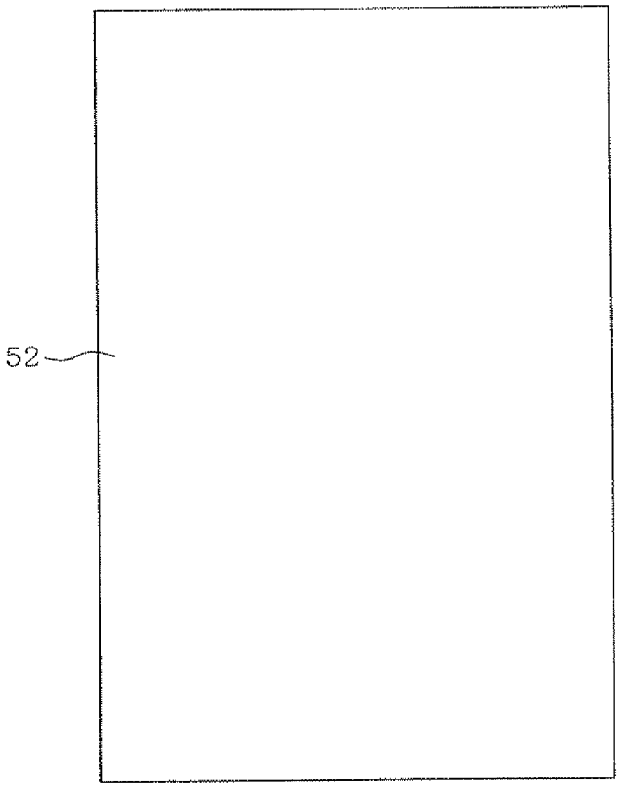
FIGS. 4A, 4B and 4C are plan, front and right side views of a placement pedestal respectively.
Figure 4C:
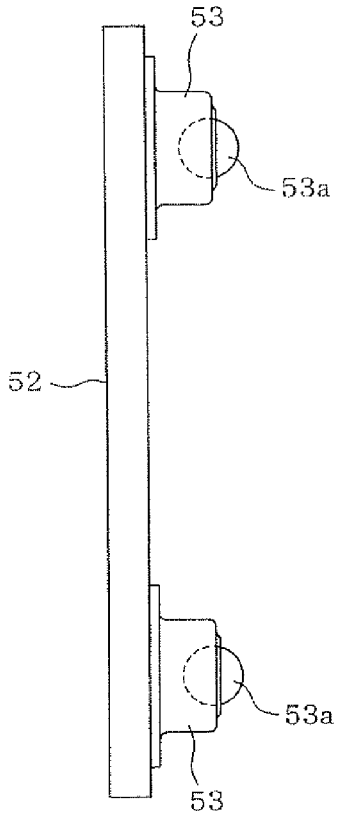
Figure 4B:
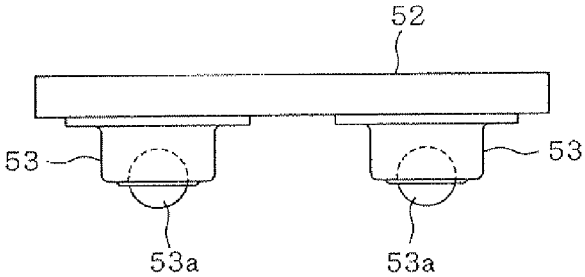
Figure 5:
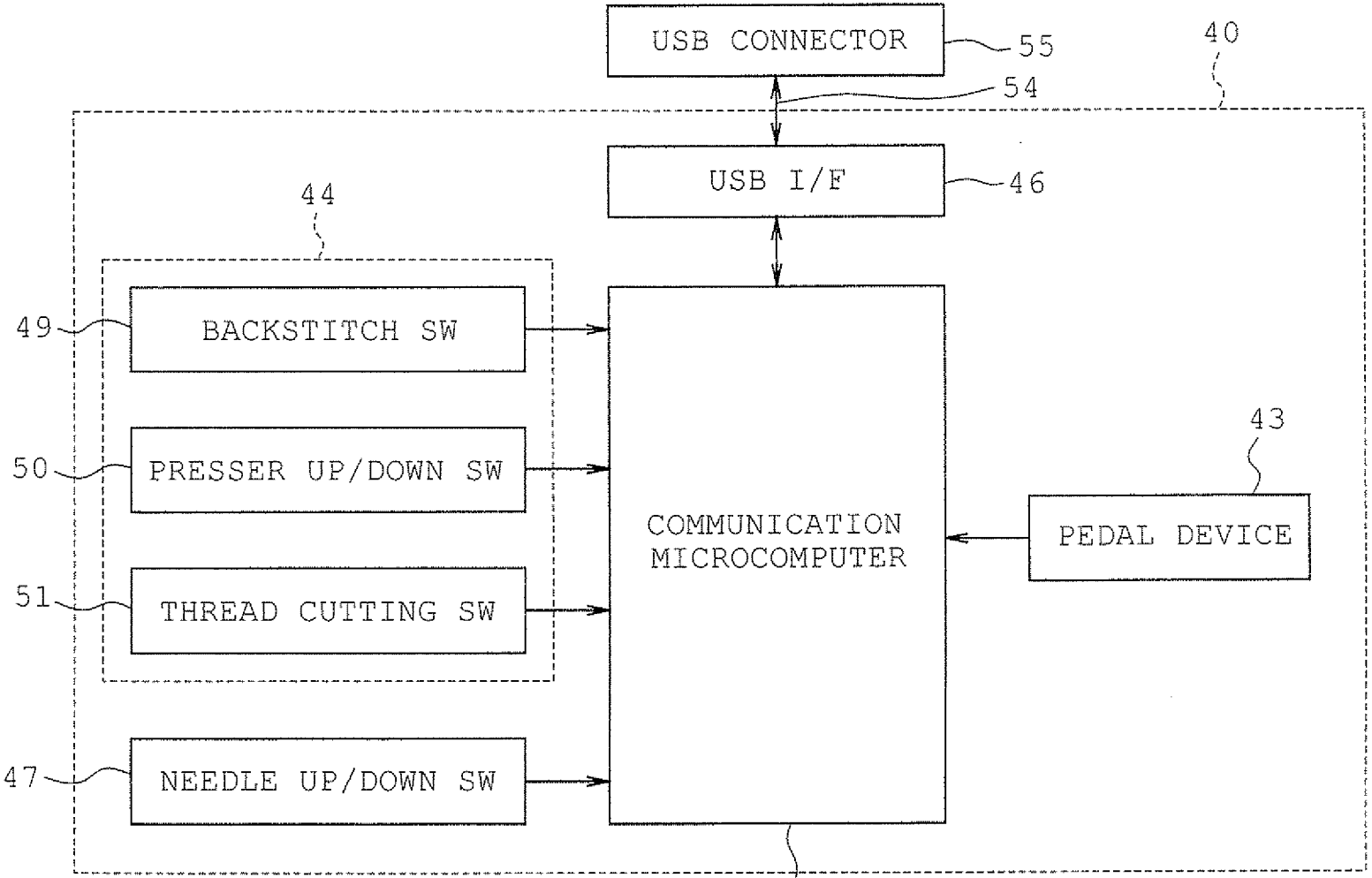
FIG. 5 is a schematic block diagram showing an electrical arrangement of the sewing machine operating device.

The placement pedestal 52 is disposed in the space inside the rising wall 48 on the base 41 as shown in FIGS. 4A to 4C. The user's foot or more specifically, the user's left foot is placed on the placement pedestal 52. The placement pedestal 52 is formed into the shape of a rectangular flat plate which is slightly longer in the Y direction. The placement pedestal 52 is set so as to be smaller than the space inside the rising wall 48 and slightly larger than user's foot. The placement pedestal 52 has an underside provided with four casters 53 located near four corners respectively. Each caster 53 comprises a ball caster comprising a ball 53*a* which serves as a rotating body and is mounted so as to be omnidirectionally rotatable so that a part of the ball 53*a* projects below a caster body, as shown in FIGS. 4B and 4C. The four casters 53 serve as a support unit.

When the ball 53*a* of the caster 53 rolls freely on the base 41, the placement pedestal 52 is supported so as to be movable in any direction in the space inside the rising wall 48 with user's foot being placed thereon. Furthermore, the switches 49 to 51 are disposed so as to be located at such respective heightwise positions that the user can depress the switches 49 to 51 with his/her toe or right or left side of the foot while placing the foot on the placement pedestal 52, as shown in FIG. 3B. The switches 49 to 51 serve as detection units which detect that user's foot occupies any one of a plurality of different predetermined positions or more specifically, at a position where any one of the switches 49 to 51 is depressed. The switches 49 to 51 may be depressed by side surfaces of the placement pedestal 52, instead of with user's foot. In this case, the placement pedestal 52 is formed so as to be slightly larger than the foot size, and the switches 49 to 51 are provided at heightwise positions opposed to the side surfaces of the placement pedestal 52 respectively.

To the communication microcomputer 45 are supplied an output signal generated by the pedal device 43, a signal generated by the needle up/down switch 47 and signals generated by the backstitch switch 49, the presser up/down switch 50 and the thread cutting switch 51 of the switch operation portion 44. The USB interface 46 is connected to the communication microcomputer 45. Furthermore, a USB connector 55 is connected to a distal end of a cable 54 which is further connected to the USB interface 46. The USB interface 46, the USB connector 55, the USB interface 32 and the USB connector 39 of the control device 25 of the sewing machine body 1 conforms to USB standards version 2.0 or higher and accordingly has a sufficient high data communication speed.

When the USB connector 55 is connected to the USB connector (port) 39 of the sewing machine body 1 as shown in FIG. 1, the operating device 40 is connected to the control device 25 of the sewing machine body 1, whereby a connecting mechanism is configured which executes communication or data transmission conforming to the USB standards. In this case, the communication microcomputer 45 is configured to deliver operation signals according to operations of the pedal device 43, the needle up/down switch 47, the backstitch switch 49, the presser up/down switch 50 and the thread cutting switch 51 to the sewing machine body 1 side. The communication microcomputer 45 thus serves as an output unit. Drive power for the operating device 40 is supplied via the USB connector 55 from the sewing machine 1 side.

The working of the operating device 40 constructed above will be described as follows with reference to FIGS. 6 and 7 as well as FIGS. 1 to 5. The user firstly places the operating device 40 at his/her feet when desiring to do sewing with the use of the sewing machine body 1. The user then connects the USB connector 55 to the USB connector (port) of the sewing machine body 1, so that the operating device 40 can be used. In this case, when manipulating the operating device 40 with his/her foot, the user can carry out various operations for the sewing operation while holding the workpiece cloth as an object to be sewn with both hands. More specifically, the sewing machine motor 11 can be started up when the user puts his/her right foot on the actuating portion 43*a* of the pedal device 43 and pressing the actuating portion 43*a* downward. Furthermore, the sewing machine motor 11 can be stopped when the user takes his/her right foot off the actuating portion 43*a*. Additionally, a sewing speed or a rotational speed of the sewing machine motor 11 can be adjusted by adjustment of an amount of pressure against the actuating portion 43*a*.

Furthermore, the user can switch a stop position of the needle bar 6 to the needle-up position or the needle-down position when pressing the needle up/down switch 47 with his/her right foot. More specifically, when the needle up/down switch 47 is pressed downward while the needle bar 6 is stopped at the needle-down position, the needle bar 6 is moved from the needle-down position to the needle-up position. On the contrary, when the needle up/down switch 47 is pressed downward while the needle bar 6 is stopped at the needle-up position, the needle bar 6 is moved from the needle-up position to the needle-down position.

The user can depress each one of the switches 49 to 51 of the switch operation portion 44 when putting his/her left foot on the placement pedestal 52 and then displacing the left foot while the left foot is kept on the placement pedestal 52. In this case, the four casters 53 having the respective balls 53*a* freely rolling on the upper surface of the base 41 are mounted on the bottom of the placement pedestal 52. Accordingly, the placement pedestal 52 can be moved smoothly with application of a small force. As a result, the user can easily move his/her left foot put on the placement pedestal 52, in any direction and to any position.

In the above-described case, the user can instruct the backstitch operation when moving the left foot rightward and depressing the backstitch switch 49 with the right side of the left foot. Furthermore, the user can instruct an operation to move the presser foot 9 upward or downward when moving the left foot rearward to depress the presser up/down switch 50 with the toe of his/her left foot. Thus, when the presser up/down switch 50 is depressed while the presser foot 9 is located at the lower position, the presser foot 9 is moved from the lower position to the upper position. On the contrary, when the presser up/down switch 50 is depressed while the presser foot 9 is located at the upper position, the presser foot 9 is moved from the upper position to the lower position. Additionally, the user can instruct a thread cutting operation when moving his/her left foot leftward to depress the thread cutting switch 51 with the left side of his/her left foot.

The left movable wall 48*b* or the thread cutting switch 51 can be changed between the right and left positions according to user's request as the result of provision of the distance adjusting mechanism 56 which adjusts the position of the left movable wall 48*b* or the thread cutting switch 51 with respect to the right-left direction, as described above. For example, the distance between the two switches 49 and 51 or between the right and left walls is increased when the user has big feet. The distance between the switches 49 and 51 is reduced when the user has small feet. Thus, the switches 49 and 51 can be disposed according to the size of the user's feet and can accordingly be located at respective suitable positions where the user can easily operate these switches.

When the operating device 40 is connected to the sewing machine, the control device 25 of the sewing machine body 1 monitors an operation signal supplied thereto from the operating device 40 to execute a processing according to the signal. FIG. 6 is a flowchart showing a procedure of periodic timer processing executed by the control device 25 (CPU 26) of the sewing machine body 1. FIG. 7 is a flowchart showing detailed procedure of a matrix processing at step S13 in the flowchart of FIG. 6.

Upon start of the periodic timer processing in FIG. 6, the control device 25 determines at step S1 whether or not it is time to read a switch signal. The control device 25 proceeds to step S10 when it is not time to read the switch signal (NO at step S1), the control device 25 proceeds to step S10. When it is time to read the switch signal (YES at step S1), the control device 25 proceeds to step S2 to determine whether or not the backstitch switch 49 has been turned on. The control device 25 proceeds to step S4 when the backstitch switch 49 has not been tuned on (NO at step S22). When the backstitch switch 49 has been turned on (YES at step S2), the control device 25 proceeds to step S3 to turn on the backstitch flag, thereafter proceeding to step S4.

The control device 25 determines at step S4 whether or not the needle up/down switch 47 has been turned on. When the needle up/down switch 47 has not been turned on (NO at step S4), the control device 25 proceeds to step S6. When the needle up/down switch 47 has been turned on (YES at step S4), the control device 25 proceeds to step S5 to turn on a needle up/down flag, further proceeding to step S6. The control device 25 determines at step S6 whether or not the thread cutting switch 51 has been operated. When the thread cutting switch 51 has not been turned on (NO at step S6), the control device 25 proceeds to step S8. When the thread cutting switch 51 has been turned on (YES at step S6), the control device 25 proceeds to step S7 to turn on the thread cutting flag, thereafter proceeding to step S8.

The control device 25 determines at step S8 whether or not the presser up/down switch 50 has been turned on. When the presser up/down switch 50 has not been turned on (NO at step S8), the control device 25 proceeds to step S10. When the presser up/down switch 50 has been turned on (YES at step S8), the control device 25 proceeds to step S9 to turn on a presser up/down flag, proceeding to step S10. The control device 25 determines at step S10 whether or not it is time to read an output signal (AD value) of the pedal device 43. When it is not time to read the AD value (NO at step S10), the control device 25 proceeds to step S12. When it is time to read the AD value (YES at step S10), the control device 25 proceeds to step S11 to read the AD value and set a variable JoyAD to the AD value, thereafter proceeding to step S12.

The control device 25 determines at step S12 whether it is time to execute a matrix processing. The control device 25 proceeds to step S14 when it is not time to execute the matrix processing (NO at step S12). When it is time to execute the matrix processing (YES at step S12), the control device 25 proceeds to step S13 to execute the matrix processing, thereafter proceeding to step S14. The control device 25 determines at step S14 whether or not it is time to change a motor speed. The control device 25 ends processing when it is not time to change the motor speed (NO at step S14). When it is time to change the motor speed (YES at step S14), the control device 25 proceeds to step S15 to instruct a motor speed based on the value of a variable JoyAD, ending the processing.

Next, the matrix processing at step S13 in FIG. 6 will be described in more detail with reference to the flowchart of FIG. 7. The control device 25 determines at step S21 whether or not the backstitch flag is on. When the backstitch flag is on (YES at step S21), the control device 25 proceeds to step S22 to execute the backstitch, thereafter ending the processing or returning. When the backstitch flag is not on (NO at step S21), the control device 25 proceeds to step S23 to determine whether or not the needle up/down flag is on. When the needle up/down flag is on (YES at step S23), the control device 25 proceeds to step S24 to execute switching the stop position of the needle bar 6 between the needle-up position and the needle-down position, thereafter ending the processing.

When the needle up/down flag is not on (NO at step S23), the control device 25 proceeds to step S25 to determine whether or not a thread cutting flag is on. When the thread cutting flag is on (YES at step S25), the control device 25 proceeds to step S26 to cause the automatic thread cutting mechanism to execute the thread cutting, thereafter ending the processing. When the thread cutting flag is not on (NO at step S25), the control device 25 proceeds to step S27 to determine whether or not a presser up/down flag is on. When the presser up/down flag is on (YES at step S27), the control device 25 proceeds to step S28 to cause the presser driving mechanism to move the presser foot 9 upward or downward, thereafter ending the processing. When the presser up/down flag is not on (NO at step S27), the control device 25 ends the processing.

Figure 7:
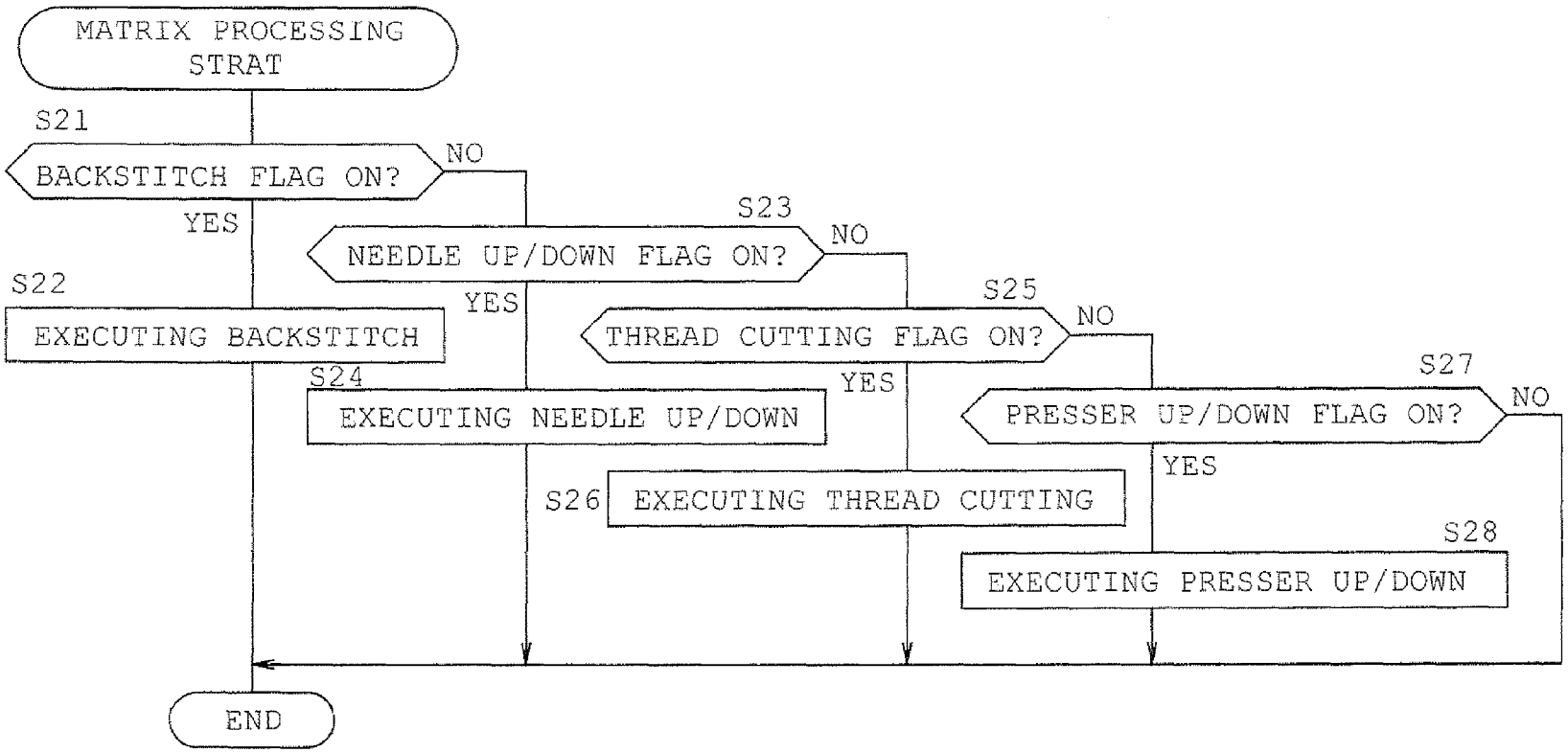
FIG. 7 is a flowchart showing a detailed processing procedure of step S13 in FIG. 6.

Even when a plurality of switches 49 to 52 of the switch operation portion 44 is simultaneously turned on as the result of processing as shown in FIG. 7, only the operation assigned with higher priority or a smaller step number is effected, whereupon simultaneous execution of two operations can be prevented.

According to the above-described operating device 40, the placement pedestal 52 on which user's foot is put is supported by the casters 53 so as to be movable freely in any direction. The user depresses the backstitch switch 49, the presser up/down switch 50 or the thread cutting switch 51 of the switch operation portion 44 while moving the placement pedestal 53 with his/her foot being retained on the placement pedestal 53. Thus, the user can easily move his/her foot while keeping his/her foot on the placement pedestal 52. Consequently, the operability of the switch operation portion 44 can be improved.

In particular, the embodiment employs the casters 53 having respective balls 53*a* as the support unit which supports the placement pedestal 52 so that the placement pedestal 52 is freely movable. Consequently, the construction of the operating device 40 can be simplified. Furthermore, the user can move the placement pedestal 52 smoothly by application of a smaller force. Additionally, the pushbutton switches 49 to 51 are used each as the detection unit which detects that user's foot or the placement pedestal 52 is located at any one of the predetermined positions. Consequently, the configuration of the detection unit can be simplified and accordingly, the cost of the detection unit can be reduced.

Furthermore, the connection unit provided with a communication system conforming to the USB standards is employed as the connection unit which connects between the operating device 40 and the sewing machine body 1. Accordingly, the operating device 40 can be connected to a sewing machine provided with the USB connector (port) 39, thereby improving the general versatility thereof. The operating device 40 can be connected to a personal computer in order that various settings (rewrite of set data) may be executed using the personal computer. It is needless to say that the advantageous effects of the USB standards such as high-speed data transfer can be achieved.

Second to fifth embodiments will be described as follows with reference to FIGS. 8A to 8C, 9A to 9C, 10A to 10C and 11A to 11C respectively. The second to fifth embodiments are also directed to the operating device which is connected to the sewing machine body 1 as in the first embodiment. Identical or similar parts in the second to fifth embodiments are labeled by the same reference symbols as those in the first embodiment, and the description of these parts will be eliminated. The following describes only the difference between the first embodiment and the second to fifth embodiments.

Figure 8A:
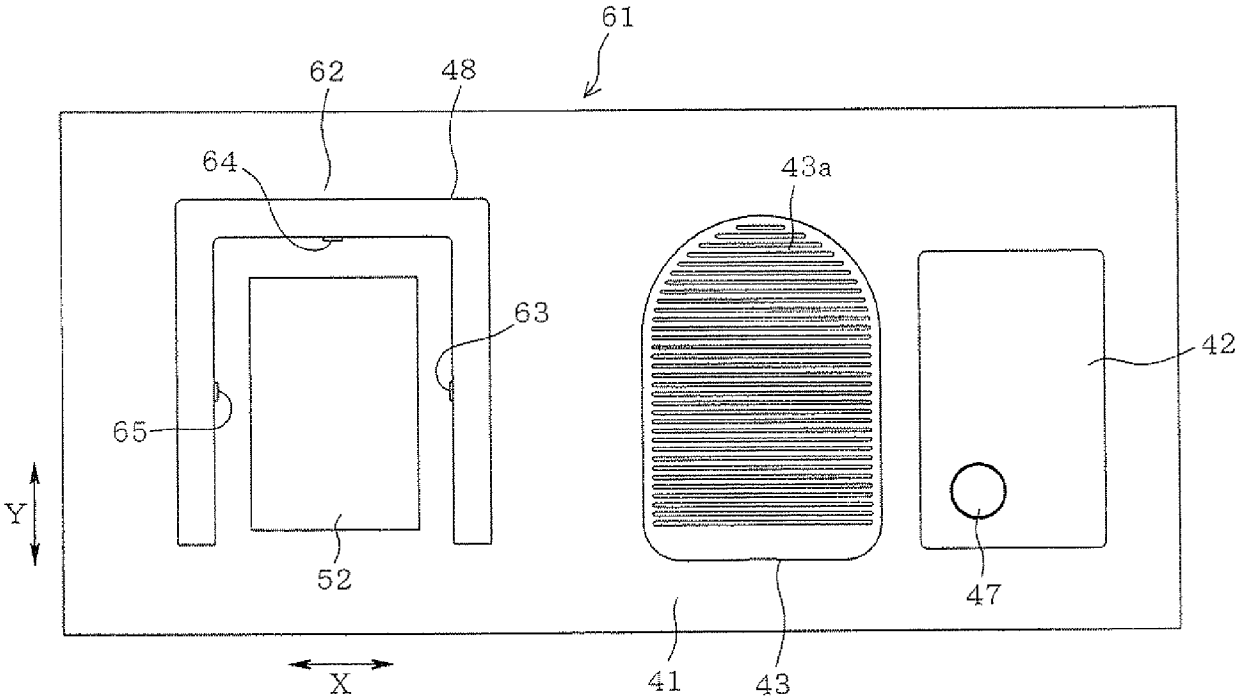
FIGS. 8A, 8B and 8C are views similar to FIGS. 3A, 3B and 3C, showing a second embodiment, respectively.
Figure 8B:
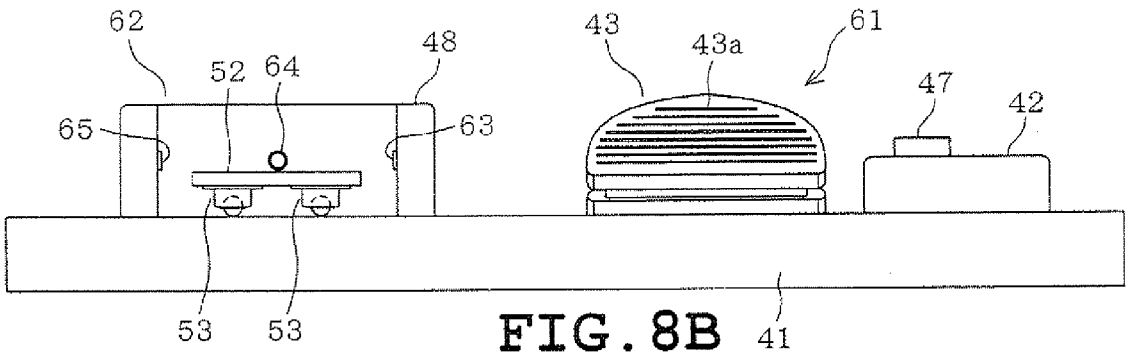
Figure 8C:
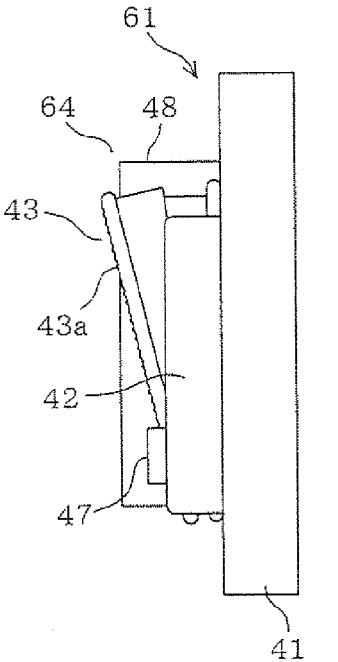
Figure 9C:
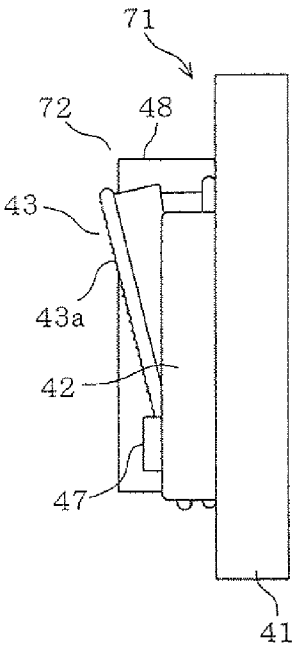
FIGS. 9A, 9B and 9C are views similar to FIGS. 3A, 3B and 3C, showing a third embodiment, respectively.
Figure 9A:
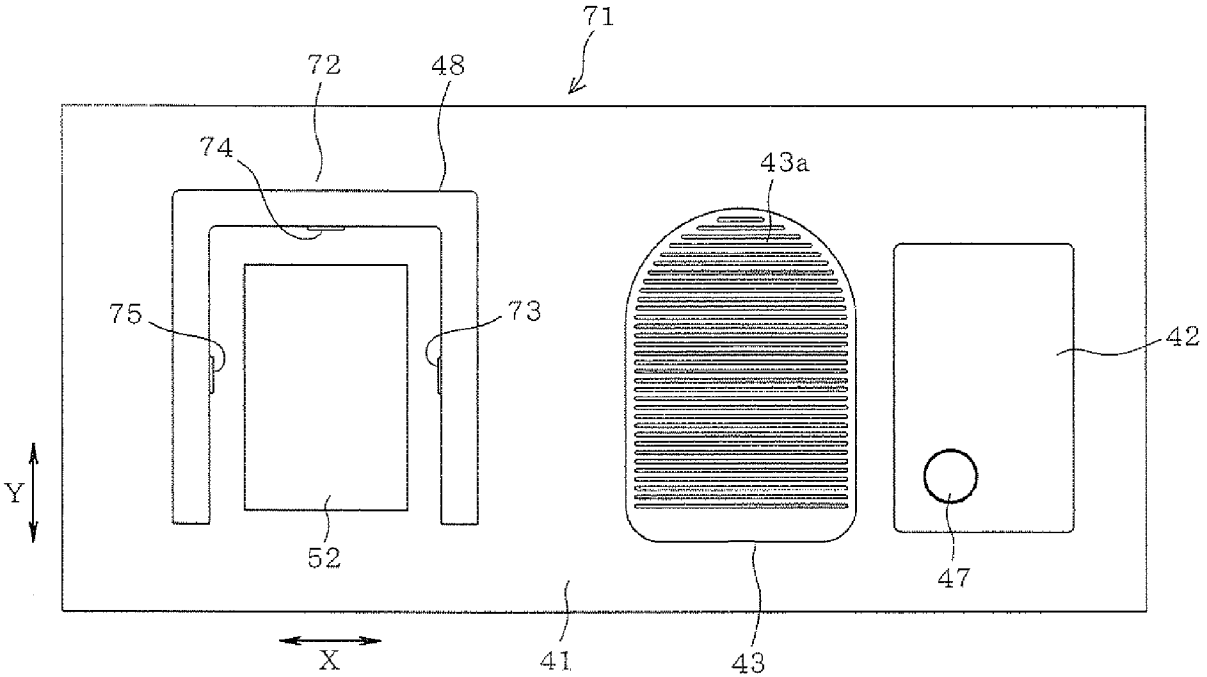
Figure 9B:
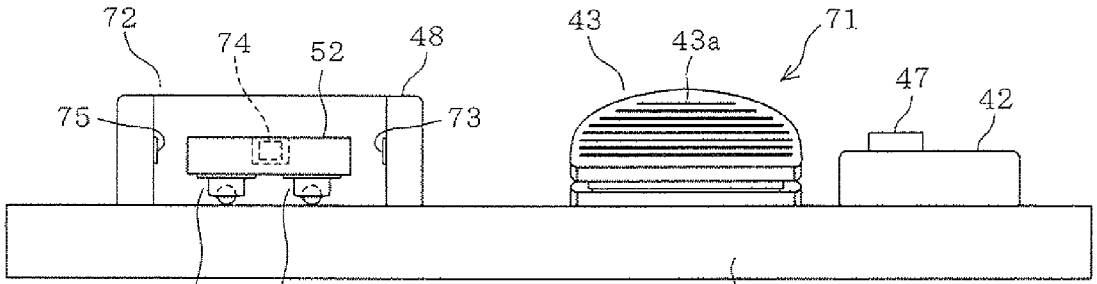
Figure 10A:
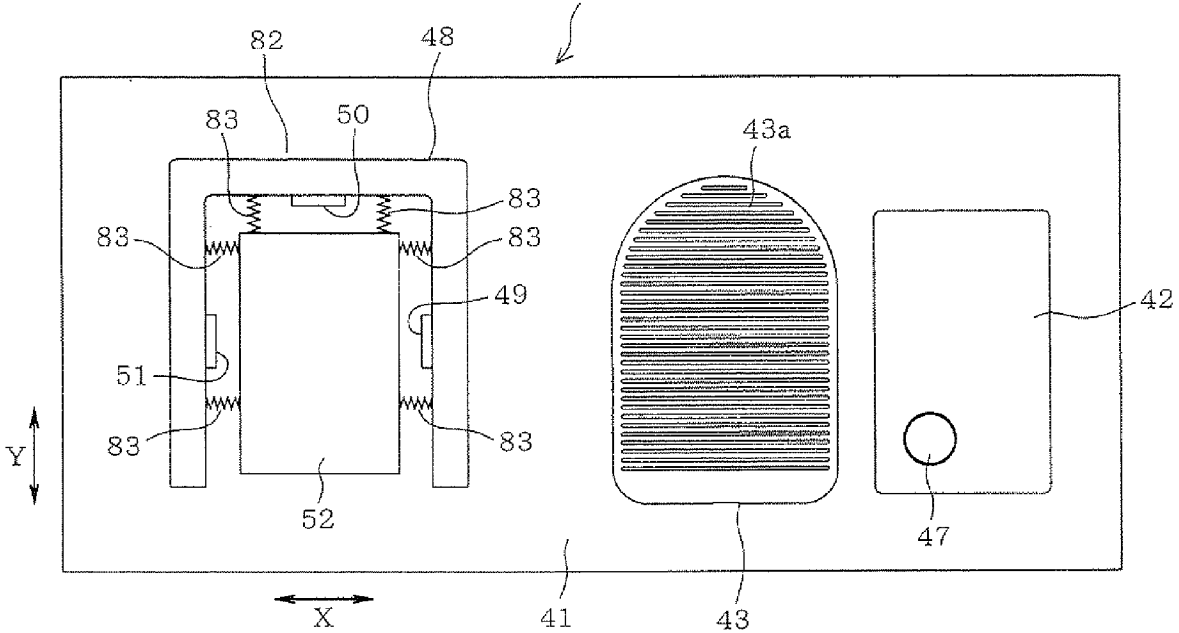
FIGS. 10A, 10B and 10C are views similar to FIGS. 3A, 3B and 3C, showing a fourth embodiment, respectively.
Figure 10B:
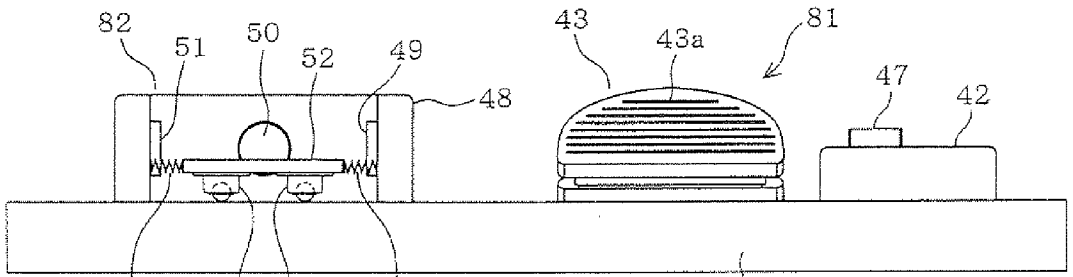
Figure 10C:
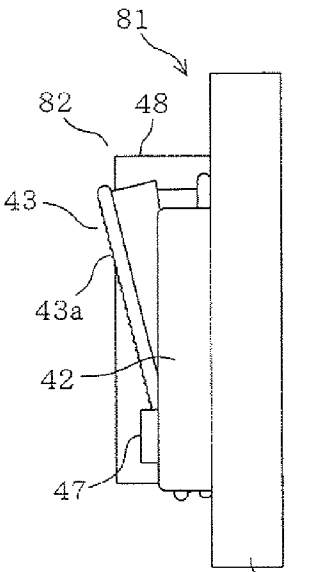

The operating device 61 of the second embodiment differs from the operating device 40 of the first embodiment in the configuration of the switch operation portion 62 located at the left part of the base 41 as shown in FIGS. 8A to 8C. Photosensors are used as the detection units provided on the inner surfaces of the right, rear and left walls of the rising wall 48, instead of the pushbutton switches. More specifically, a backstitch sensor 63, a presser up/down sensor 64 and a thread cutting sensor 65 detecting that the user's foot is located at respective predetermined positions are provided as the detection units. Each of the sensors 63 to 65 comprises an infrared sensor which detects infrared rays emitted from a human body. Each sensor is configured to detect (an operation) that user's foot is in proximity within a predetermined distance.

The backstitch sensor 63 detects user's left foot when the user moves his/her left foot rightward so that the user's left foot comes closer to the backstitch sensor 63 while user's left foot is kept on the placement pedestal 52. The control device 25 accordingly instructs a backstitch operation. Furthermore, when the user moves his/her left foot rearward so that the foot comes closer to the presser up/down sensor 64, the presser up/down sensor 64 detects user's left foot. The control device 25 accordingly instructs an operation of moving the presser foot 9 upward or downward. Additionally, when the user moves his/her left foot leftward so that the foot comes closer to the thread cutting sensor 65, the thread cutting sensor 65 detects user's left foot. The control device 25 accordingly instructs a thread cutting operation.

Thus, when the user moves his/her foot while keeping the foot on the placement pedestal 52, the backstitch sensor 63, the presser up/down sensor 64 or the thread cutting sensor 65 each comprising the infrared sensor detects proximity of user's foot. As a result, in the second embodiment, too, the user can move his/her foot easily while keeping his/her foot on the placement pedestal 52. Furthermore, since the sewing machine body 1 is run by a simple operation of causing the foot to come close to each of the sensors 63 to 65, the operability of the switch operation portion 62 can further be improved. Furthermore, the configuration of the detection unit can be simplified and accordingly, the cost thereof can be decreased.

In the third embodiment, the switch operation portion 72 includes the backstitch sensor 73, the presser up/down sensor 74 and the thread cutting sensor 75 each of which comprises a photosensor. In more detail, each one of the sensors 73 to 75 comprises a reflective photosensor (not shown) having a light emitting portion and a light receiving portion both of which are juxtaposed to each other. Each reflective photosensor is configured to emit light which is reflected on a surface of an object to be received by the light receiving portion, thereby detecting proximity of the object, as well known in the art. In the embodiment, the side surfaces of the placement pedestal 52 serve as reflecting surfaces which reflect the light emitted from the light emitting portions, respectively. Alternatively, dedicated reflecting plates may be mounted on the sides of the placement pedestal 52 for improvement in the detection accuracy, respectively.

In operation of the operating device 71, the user moves the placement pedestal 52 with his/her left foot being put thereon to cause the right side surface of the placement pedestal 52 to come closer to the backstitch sensor 73. The backstitch sensor 73 then detects the proximity of the placement pedestal 52, so that the control device 25 accordingly instructs a backstitch operation. In the same manner, the placement pedestal 52 is moved rearward so that the rear surface of the placement pedestal 52 is caused to come closer to the presser up/down sensor 74. The presser up/down sensor 74 then detects the proximity of the placement pedestal 52, so that the control device 25 accordingly instructs the upward or downward movement of the presser foot 9. Furthermore, when the placement pedestal 52 is moved leftward to cause the left side of the placement pedestal 52 to come closer to the thread cutting sensor 75, the thread cutting sensor 75 detects the proximity of the placement pedestal 52, so that the control device 25 accordingly instructs thread cutting.

In the third embodiment, too, the user can easily move his/her foot while keeping the foot on the placement pedestal 52 as in the second embodiment. Furthermore, since the sewing machine body 1 is run by a simple operation of causing the placement pedestal 52 to come close to each of the sensors 73 to 75, the operability of the switch operation portion 72 can further be improved. Furthermore, the configuration of the detection unit can be simplified and accordingly, the cost thereof can be decreased.

The operating device 81 of the fourth embodiment differs from the operating device 40 of the first embodiment in that the switch operation portion 82 is provided with a return unit which returns the placement pedestal 52 to a neutral position which is not detected by the detection unit (the switches 49, 50 and 51) when the placement pedestal 52 has been released from a force applied to the placement pedestal 52 by user's foot.

More specifically, three pairs of coil springs 83 are provided so as to extend between the right wall inner surface of the rising wall 48 and the right side of the placement pedestal 52, between the left wall inner surface of the rising wall 48 and the left side of the placement pedestal 52 and between the rear wall inner surface of the rising wall 48 and the rear of the placement pedestal 52 respectively. Accordingly, when the user moves the placement pedestal 52 rightward from the neutral position while keeping his/her foot on the placement pedestal 52, the two coils 83 disposed between the right wall inner surface of the rising wall 48 and the right side of the placement pedestal 52 is compressed, whereas the other four coil springs 83 are pulled thereby to be expanded. Subsequently, when the user releases the placement pedestal 52 from application of the operating force by user's foot or removes his/her foot from the placement pedestal 52, an elastic force returns each expanded coil spring 38 to its initial state, whereby the placement pedestal 52 is returned to its neutral position.

According to the fourth embodiment, the placement pedestal 52 can automatically be returned to the neutral position as the result of provision of the coil springs 83 serving as the return units. This can eliminate the operation for the user to return the placement pedestal 52 to the neutral position, whereupon the operability of the operating device can further be improved.

Figure 11C:
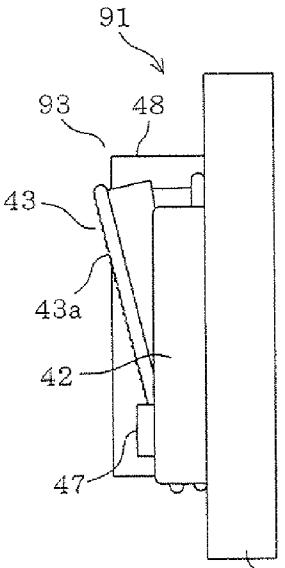
FIGS. 11A, 11B and 11C are views similar to FIGS. 3A, 3B and 3C, showing a fifth embodiment, respectively.
Figure 11A:
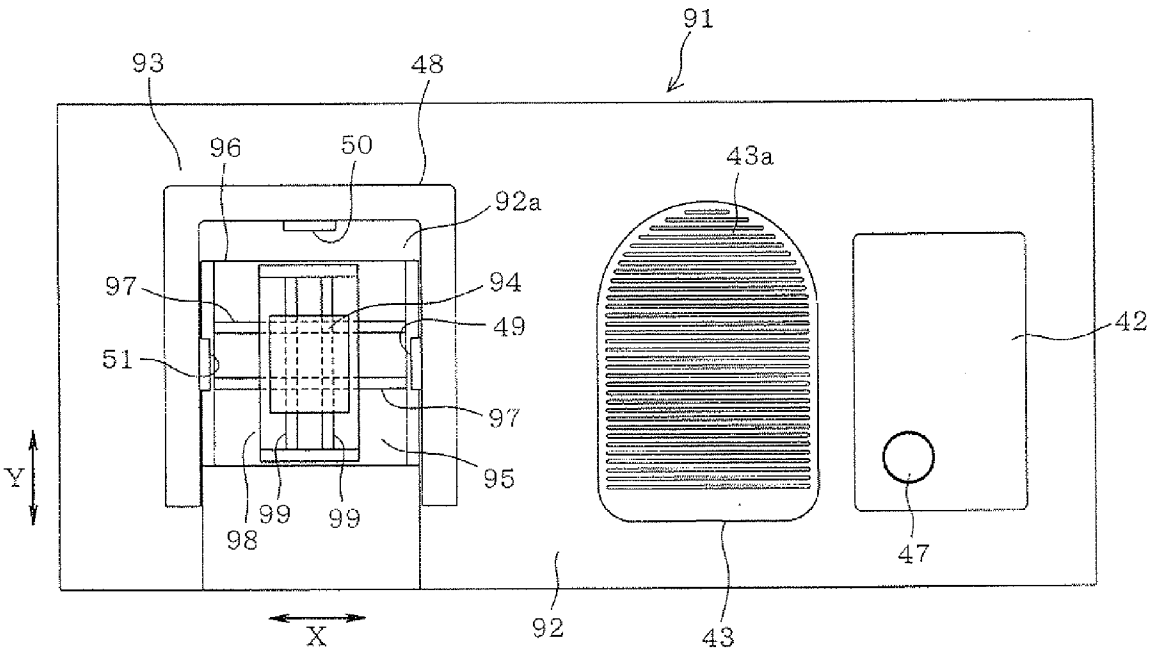
Figure 11B:
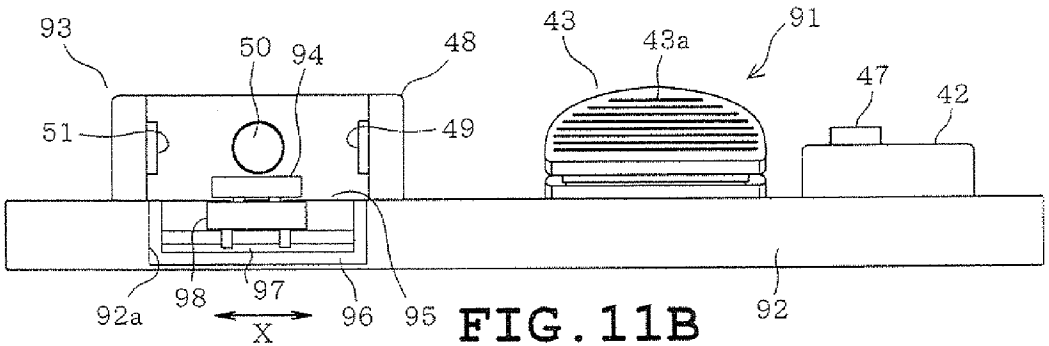
Figure 12C:
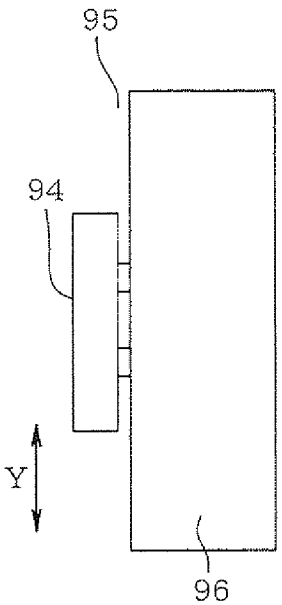
FIGS. 12A, 12B and 12C are plan, front and right side views of the slide mechanism respectively.
Figure 12A:
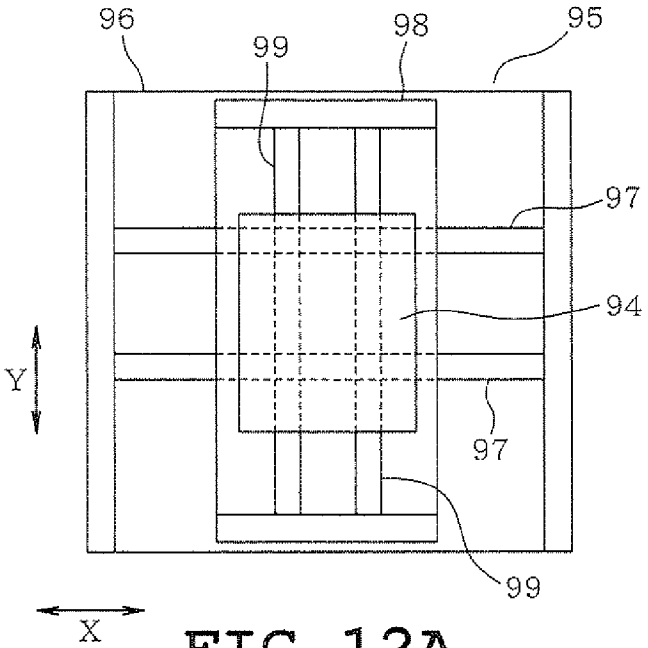
Figure 12B:
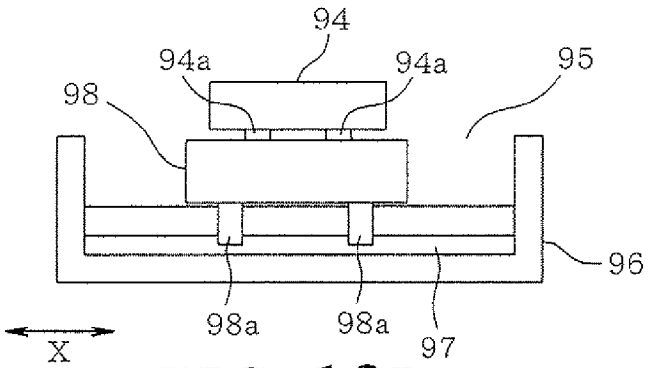

The operating device 91 of the fifth embodiment is provided with the switch operation portion 93 including the backstitch switch 49, the presser up/down switch 50 and the thread cutting switch 51 each of which comprises the push-button switch, as shown in FIGS. 11A to 11C. The placement pedestal 94 on which user's foot is to be put is disposed inside the rising wall 48 on the base 92. The placement pedestal 94 is supported by a slide support mechanism 95 serving as the support unit so as to be slidable in a predetermined direction. In the embodiment, the slide support mechanism 95 supports the placement pedestal 95 so that the placement pedestal 94 is movable in the right-left or X direction and the front-back or Y direction.

The slide support mechanism 95 is formed into a generally square shape and includes a base plate 96 having two walls at right and left sides thereof. Two X-direction rails 97 extending in the right-left or X direction are mounted on an upper surface (bottom) of the base plate 96. An intermediate slide plate 98 is mounted on the x-direction rails 97 so as to be slidable in the right-left or X direction. The intermediate slide plate 98 is formed into a generally rectangular plate shape that is elongate in the front-back direction. For example, four sliders 98*a* are provided on the underside of the intermediate slide plate 98. The sliders 98 are slidably engaged with the X-direction rails 97 such that the intermediate slide plate 98 is supported so as to be slidable in the right-left or X direction. Two Y-direction rails 99 extending in the front-back or Y direction are mounted on an upper surface of the intermediate slide plate 98. The placement pedestal 94 is supported on the Y-direction rails 99 so as to be slidable in the front-back or Y direction. Sliders 94*a* are mounted on the underside of the placement pedestal 94. The sliders 94*a* are slidably engaged with the Y-direction rails 99 such that the placement pedestal 94 is supported so as to be slidable in the front-back or Y direction. As a result, the placement pedestal 94 is supported so as to be movable on the intermediate slide plate 98 in the front-back direction and so as to be movable together with the intermediate slide plate 98 in the right-left direction.

The slide support mechanism 95 constructed above is fitted into a recess 92*a* formed inside the wall 48 on the base 92 from above thereby to be mounted, as shown in FIG. 11B. The placement pedestal 94 is located at a heightwise position suitable for the user to depress the switches 49 to 51. The user can operate the switches 49 to 51 when moving his/her foot in the front-back direction and in the right-left direction together with the placement pedestal 94 while keeping the foot on the placement pedestal 94. In the fifth embodiment, too, the coil springs may be provided for returning the placement pedestal 94 to the neutral position in the same manner as in the fourth embodiment.

The fifth embodiment can achieve the improvement in the operability of the switch operation portion 93 and the like as in the first embodiment. In addition, the fifth embodiment employs the slide support mechanism which serves as the support unit and supports the placement pedestal 94 so that the placement pedestal 94 is movable in the X and Y directions. Consequently, the placement pedestal 94 can smoothly be moved by application of smaller force.

The foregoing embodiments should not be restrictive but may be expanded or modified as follows. For example, in each foregoing embodiment, the operating device comprises the pedal device and the four switches or sensors. The number of switches or sensors may be not less than 5 or not more than 3. Furthermore, although the reflection photosensors are used in the third embodiment, transmission type photosensors may be provided, instead. In this case, protrusions are formed on a part of the placement pedestal so that light shielding is provided between the light emitting portion and the light receiving portion. Furthermore, proximity sensors or magnetic sensors may be provided instead of the photosensors. Furthermore, various modifications may be made for the layout of the upper surface of the base. For example, the control box and the pedal device may be disposed on a left part of the upper surface of the base and the switch operation portion may be disposed on a right part of the upper surface of the base, and user's right foot may be put on the placement pedestal, instead. Furthermore, for example, when only two or right and left switches are provided in the switch operation portion, the slide support mechanism may be used which supports the placement pedestal so that the placement pedestal is movable only in the right-left direction.

The casters mounted on the underside of the placement pedestal may be identical with those used with carriages or wagons. More specifically, casters may be provided each of which comprises a wheel rotatable about both horizontal and vertical axes. Furthermore, either the placement pedestal or the base may be made of a synthetic resin material having a low coefficient of friction, instead of use of casters. Additionally, sheets (sliding sheets) each made of a synthetic resin material having a low coefficient of friction may be provided on contact surfaces of the placement pedestal and the base respectively.

Additionally, various changes and modifications may be made in the construction of the sewing machine body and the construction of the connection unit connecting the operating device to the sewing machine body.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A sewing machine operating device comprising:

a base;

a connection unit which is connectable to a sewing machine body;

an output unit which is configured to generate and deliver an operation signal according to an action of a user's foot;

a placement pedestal that is configured to receive the user's foot;

a support unit which supports the placement pedestal so that the placement pedestal is movable in any direction on a plane that includes an upper surface of the base; and a detection unit which is configured to detect whether the placement pedestal or user's foot is located at any one of different predetermined positions when the placement pedestal is moved with the user's foot being placed on the placement pedestal.

2. The operating device according to claim 1, wherein the support unit includes a rotating body which is rotatably supported on a bottom of the placement pedestal.

3. The operating device according to claim 1, wherein the support unit includes a slide support mechanism which supports the placement pedestal so that the placement pedestal is movable in a predetermined direction.

4. The operating device according to claim 1, wherein at least one detection unit is disposed around the placement pedestal and includes a switch operated with the placement pedestal or user's foot or a sensor detecting that the placement pedestal or user's foot occupies a predetermined position.

5. The operating device according to claim 1, further comprising a return unit which returns the placement pedestal to a neutral position which is not detected by the detection unit when the placement pedestal has been released from an operation force applied to the placement pedestal by the user's foot.

6. The operating device according to claim 1, wherein the connection unit employs a communication system conforming to USB standards.

7. A sewing machine comprising:

a sewing machine body; and a sewing machine operating device including:

a base;

a connection unit which is connectable to the sewing machine body;

an output unit which is configured to generate and deliver an operation signal according to an action of a user's foot;

a placement pedestal that is configured to receive the user's foot;

a support unit which supports the placement pedestal so that the placement pedestal is movable in any direction on a plane that includes an upper surface of the base; and a detection unit which is configured to detect whether the placement pedestal or user's foot is located at any one of different predetermined positions when the placement pedestal is moved with the user's foot being placed on the placement pedestal.

8. The sewing machine according to claim 7, wherein the support unit includes a rotating body which is rotatably supported on a bottom of the placement pedestal.

9. The sewing machine according to claim 7, wherein the support unit includes a slide support mechanism which supports the placement pedestal so that the placement pedestal is movable in a predetermined direction.

10. The sewing machine according to claim 7, wherein at least one detection unit is disposed around the placement pedestal and includes a switch operated with the placement pedestal or user's foot or a sensor detecting that the placement pedestal or user's foot occupies a predetermined position.

11. The sewing machine according to claim 7, further comprising a return unit which returns the placement pedestal to a neutral position where the placement pedestal is not detected by the detection unit when the placement pedestal has been released from a force applied to the placement pedestal by the user's foot.

12. The sewing machine according to claim 7, wherein the connection unit employs a communication system conforming to USB standards.

* * * * *